US008933842B2

(12) United States Patent
Ayatollahi et al.

(10) Patent No.: US 8,933,842 B2
(45) **Date of Patent: *Jan. 13, 2015**

(54) WIDEBAND, HIGH ISOLATION TWO PORT ANTENNA ARRAY FOR MULTIPLE INPUT, MULTIPLE OUTPUT HANDHELD DEVICES

(75) Inventors: Mina Ayatollahi, Waterloo (CA); Qinjian Rao, Waterloo (CA); Dong Wang, Waterloo (CA)

(73) Assignee: BlackBerry Limited, Waterloo, CA (US)

( * ) Notice: Subject to any disclaimer, the term of this patent is extended or adjusted under 35 U.S.C. 154(b) by 93 days.

This patent is subject to a terminal disclaimer.

(21) Appl. No.: 13/301,259

(22) Filed: Nov. 21, 2011

(65) Prior Publication Data

US 2012/0068905 A1 Mar. 22, 2012

Related U.S. Application Data

(63) Continuation of application No. 12/405,955, filed on Mar. 17, 2009, now Pat. No. 8,085,202.

(51) Int. Cl.

| | |
|---|---|
| ***H01Q 1/38*** | (2006.01) |
| ***H01Q 21/28*** | (2006.01) |
| ***H01Q 1/24*** | (2006.01) |
| ***H01Q 1/48*** | (2006.01) |
| ***H01Q 1/52*** | (2006.01) |
| ***H01Q 9/42*** | (2006.01) |
| ***H01Q 13/10*** | (2006.01) |

(52) U.S. Cl.

CPC ..... *H01Q 21/28* (2013.01); *H01Q 1/243* (2013.01); *H01Q 1/38* (2013.01); *H01Q 1/48* (2013.01); *H01Q 1/521* (2013.01); *H01Q 9/42* (2013.01); *H01Q 13/106* (2013.01)

USPC ..... 343/700 MS

(58) Field of Classification Search

None

See application file for complete search history.

(56) References Cited

U.S. PATENT DOCUMENTS

| | | | |
|---|---|---|---|
| 5,547,100 | A | 8/1996 | Johnson |
| 5,633,646 | A | 5/1997 | Strickland |
| 5,754,143 | A | 5/1998 | Warnagiris et al. |
| 6,075,493 | A | 6/2000 | Sugawara |

(Continued)

FOREIGN PATENT DOCUMENTS

| | | | |
|---|---|---|---|
| EP | 1077505 | A2 | 2/2001 |
| EP | 1162688 | A1 | 12/2001 |

(Continued)

OTHER PUBLICATIONS

"IEEE Standard Definitions of Terms for Antennas," IEEE std 145-1983, 1983.*

(Continued)

*Primary Examiner* — Graham Smith

(74) *Attorney, Agent, or Firm* — Moffat & Co.

(57) ABSTRACT

A multiple input-multiple output antenna assembly with high isolation between the antennas is disclosed. The antenna assembly includes a substrate with a ground layer at its surface. Two antennas are disposed opposing each other on the substrate. An isolation element in a form of a patterned slot is interposed between the first and second antennas on the ground plane. A first signal port is provided for applying a first signal to excite the first antenna and a second signal port is provided for applying a second signal to excite the second antenna. The isolation element provides isolation that inhibits electromagnetic propagation between the two antennas.

12 Claims, 4 Drawing Sheets

(56) References Cited

U.S. PATENT DOCUMENTS

| | | | | |
|---|---|---|---|---|
| 6,313,798 | B1 | 11/2001 | Bancroft et al. | |
| 6,593,887 | B2 | 7/2003 | Luk et al. | |
| 6,624,789 | B1 * | 9/2003 | Kangasvieri et al. | 343/702 |
| 6,791,498 | B2 | 9/2004 | Boyle et al. | |
| 6,950,071 | B2 | 9/2005 | Wen et al. | |
| 7,023,387 | B2 | 4/2006 | Wen et al. | |
| 7,038,627 | B2 | 5/2006 | Ikuta et al. | |
| 7,352,327 | B2 | 4/2008 | Yeh et al. | |
| 7,352,328 | B2 | 4/2008 | Moon et al. | |
| 7,369,089 | B2 | 5/2008 | Wen et al. | |
| 7,400,300 | B2 | 7/2008 | Qi et al. | |
| 7,403,165 | B2 | 7/2008 | Qi et al. | |
| 7,629,930 | B2 | 12/2009 | Murch et al. | |
| 7,701,395 | B2 | 4/2010 | Alvey et al. | |
| 2004/0085245 | A1 | 5/2004 | Miyata et al. | |
| 2007/0001911 | A1 | 1/2007 | Fujio et al. | |
| 2007/0109204 | A1 | 5/2007 | Phillips et al. | |
| 2007/0152887 | A1 * | 7/2007 | Castany et al. | 343/702 |
| 2008/0062058 | A1 | 3/2008 | Bishop | |
| 2008/0231530 | A1 | 9/2008 | Rao et al. | |
| 2008/0284661 | A1 | 11/2008 | He | |
| 2008/0287171 | A1 | 11/2008 | Qi et al. | |
| 2009/0273529 | A1 | 11/2009 | Liu | |

FOREIGN PATENT DOCUMENTS

| | | | |
|---|---|---|---|
| JP | 20080167393 | | 7/2008 |
| WO | 03058759 | A1 | 7/2003 |
| WO | 03096475 | A1 | 11/2003 |
| WO | 2004015810 | A1 | 2/2004 |
| WO | WO 2007028448 | A1 * | 3/2007 |
| WO | 2008001169 | A2 | 1/2008 |
| WO | 2008049354 | A1 | 5/2008 |
| WO | 2010036955 | A1 | 4/2010 |

OTHER PUBLICATIONS

"IEEE Standard Definitions of Terms for Antennas," Approved Mar. 18, 1993, copyright 1993 by the IEEE, published 1993.*

Examination Report for EP Application No. 10156819.4 dated Apr. 13, 2011.

Extended European Search Report for Application No. 10167565.0, Sep. 30, 2010.

International Search Report and Written Opinion for Application No. PCT/CA2011/050284, Aug. 3, 2011.

Waldschmidt et al., Compact Wide-Band Multimode Antennas for MIMO and Diversity; IEEE Transactions on Antennas and Propagation, vol. 52, No. 8, Aug. 2004.

Svantesson, Correlation and Channel Capacity of MIMO Systems Employing Multimode Antennas, IEEE Transactions on Vehicular Technology, vol. 51, No. 6, Nov. 2002.

Forenza et al, Benefit of Pattern Diversity via Two-Element Array of Circular Patch Antennas in Indoor Clustered MIMO Channels, IEEE Transactions on Communications, vol. 54, No. 5, May 2006.

Vaughan, Two-Port Higher Mode Circular Microstrip Antennas, IEEE Transactions on Antennas and Propagation, vol. 36, No. 3, Mar. 1998.

Karaboikis et al., Compact Dual-Printed Inverted-F Antenna Diversity Systems for Portable Wireless Devices, IEEE Antenna and Wireless Propagation Letters, vol. 3, pp. 9-14, 2004.

Chou et al., Investigations of Isolation Improvement Techniques for Multiple Input Multiple Output (MIMO) WLAN Portable Terminal Applications, Progress in Electromagnetics Research, PIER 85, pp. 349-366, 2008.

Kim et al., High Isolation Internal Dual-Band Planar Inverted F-Antenna Diversity System with Band-Notched Slots for MIMO Terminals, 36th European Microwave Conference, pp. 1414-1417, Sep. 10-15, 2006.

Hsieh et al., Band-stop Filter Design of Coplanar Stripline, IEEE Asia-Pacific Microwave Conference, Dec. 11, 2007, pp. 1-4.

Rao et al., Compact Low Coupling Dual-Antennas for MIMO Applications in Handheld Devices, Antennas and Propagation Society International Symposium, Jun. 1, 2009, pp. 1-4.

Kim et al., The High Isolation Dual-Band Inverted F Antenna Diversity System with the Small N-Section Resonators on the Ground Plane, Asia Pacific Microwave Conference, Dec. 1, 2006, pp. 195-198.

European Search Report for Application No. 10156819.4-2220, dated Jun. 24, 2010.

* cited by examiner

WIDEBAND, HIGH ISOLATION TWO PORT ANTENNA ARRAY FOR MULTIPLE INPUT, MULTIPLE OUTPUT HANDHELD DEVICES

CROSS-REFERENCE TO RELATED APPLICATIONS

This application is a continuation of application Ser. No. 12/405,955, filed Mar. 17, 2009 now U.S. Pat. No. 8,085,202, which is incorporated herein by reference in its entirety.

STATEMENT REGARDING FEDERALLY SPONSORED RESEARCH OR DEVELOPMENT

Not Applicable

BACKGROUND

The present invention relates generally to antennas for handheld communication devices, and more particularly to multiple-input, multiple-output antennas.

Different types of wireless mobile communication devices, such as personal digital assistants, cellular telephones, and wireless two-way email communication equipment are available. Many of these devices are intended to be easily carried on the person of a user, often compact enough to fit in a shirt or coat pocket.

As the use of wireless communication equipment continues to increase dramatically, a need exists provide increased system capacity. One technique for improving the capacity is to provide uncorrelated propagation paths using Multiple Input, Multiple Output (MIMO) systems. MIMO employs a number of separate independent signal paths, for example by means of several transmitting and receiving antennas.

MIMO systems, employing multiple antennas at both the transmitter and receiver offer increased capacity and enhanced performance for communication systems without the need for increased transmission power or bandwidth. The limited space in the enclosure of the mobile communication device, however presents several challenges when designing such antennas. An antenna should be compact to occupy minimal space and its location is critical to minimize performance degradation due to electromagnetic interference. Bandwidth is another consideration that the antenna designers face in multiple antenna systems.

Furthermore, since the multiple antennas are located close to each other, strong mutual coupling occurs between their elements, which distorts the radiation patterns of the antennas and degrades system performance, often causing an antenna element to radiate an unwanted signal. Therefore, minimal coupling between antennas in MIMO antenna arrays is preferred to increase system efficiency and battery life, and improve received signal quality.

Therefore, is it desirable to develop a MIMO antenna arrangement which has a compact size to fit within a device housing that is small enough to be attractive to consumers and which has improved performance.

BRIEF DESCRIPTION OF THE DRAWINGS

FIG. 7 is a plane view of a printed circuit board on which a fourth version of a two port antenna assembly is formed; and.

DETAILED DESCRIPTION

The present two port antenna array for MIMO communication devices provides significant isolation between the two ports in a wide bandwidth, for example covering 2.25-2.8 GHZ and supporting multiple communication standards. The illustrated antenna assembly has two identical radiating elements, which, in the illustrated embodiments, comprise slot (gap) antennas and patch antennas. It should be understood, however, that alternative radiating element types may be used. The illustrated slot antennas are formed by creating two straight, open-ended slots at two opposing side edges of a conducting layer etched at one side of a printed circuit board (PCB), to form a pair of quarter wavelength slot antennas. The slots are located along one edge of the PCB opposing each other, and symmetrically with respect to the center line of the PCB. The other side of the PCB is available for mounting other components of the communication device. Each slot antenna in this configuration operates as a quarter wavelength resonant structure, with a relatively wide bandwidth. It should be understood, however, that alternative orientations, dimensions, and shapes may be used. The dimensions of the slots, their shape and their location with respect to the any edge of the PCB can be adjusted to optimize the resonance frequency, bandwidth, impedance matching, directivity, and other antenna performance parameters. It should also be understood that a slot may penetrate through the substrate of a board, in addition to the conducting layer. It should also be understood that loaded slots may be used, with resistive material either at an end or within a slot. Further, it should be understood that slots may be tuned using microelectromechanical systems (MEMS), for example by opening or closing conductive bridges across a slot.

A patterned slot is formed in the conducting layer of the PCB between the pair of slot antennas to provide isolation between the radiators, thereby minimizing electromagnetic propagation from one antenna element to the other antenna element. This is specifically achieved by isolating the currents from the antennas that are induced on the ground plane. The isolation element pattern may be symmetrical with respect to a center line between the two antenna elements, or may be non-symmetrical. The isolating slot may have a meandering pattern, such as a serpentine or an L, or other shapes. In some embodiments, the meandering shape is a serpentine slot that winds alternately toward and away from each antenna. In some embodiments, the electrical length of the isolation element slot is about quarter of the wavelength of the operating frequency. Other means for achieving high isolation between antennas can be considered by suppressing the surface waves on the ground plane, for example a layer of dielectric insulating material covered by a layer of lossy conductive material is used as the ground plane or high impedance ground plane can be used.

Figure 1:
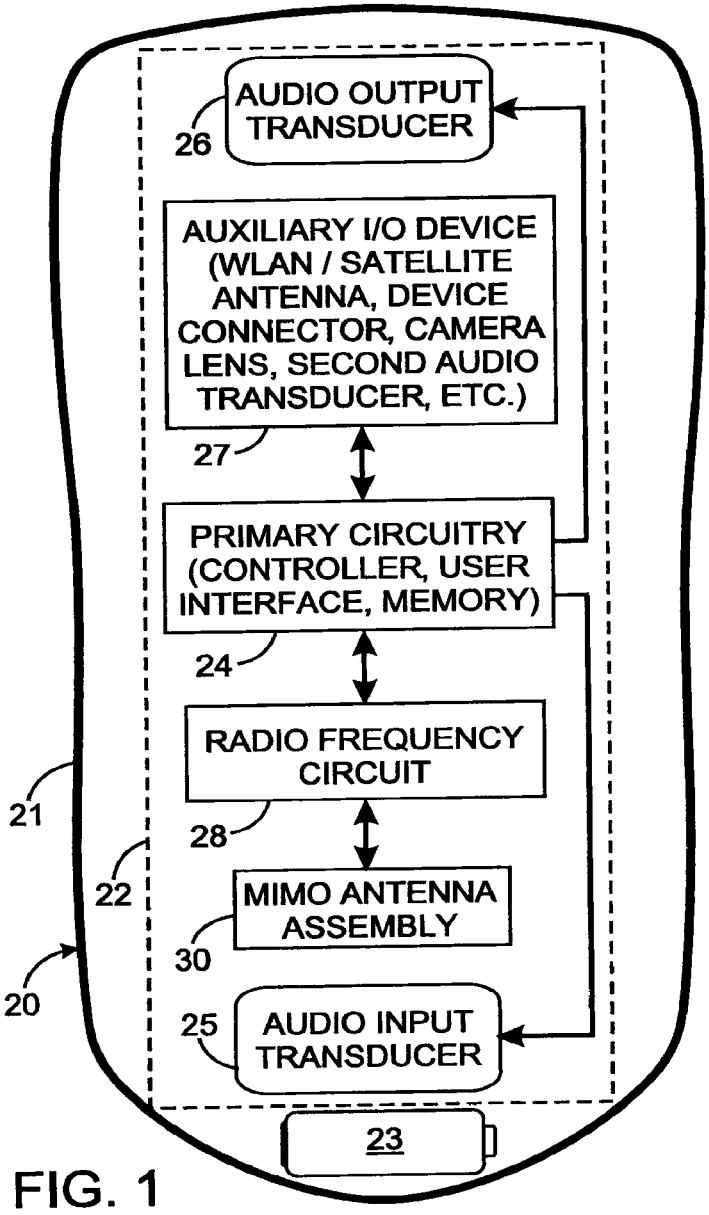
FIG. 1 is a schematic block diagram of a mobile wireless communication device that incorporates the present antenna assembly.

Referring initially to FIG. 1, a mobile wireless communication device 20, such as a cellular telephone, illustratively includes a housing 21 that may be a static housing, for example, as opposed to a flip or sliding housing which are used in many cellular telephones. Nevertheless, those and other housing configurations also may be used. A battery 23 is carried within the housing 21 for supplying power to the internal components.

The housing 21 contains a main printed circuit board (PCB) 22 on which the primary circuitry 24 for communication device 20 is mounted. That primary circuitry 24, typically includes a microprocessor, one or more memory devices, along with a display and a keyboard that provide a user interface for controlling the communication device.

An audio input device, such as a microphone 25, and an audio output device, such as a speaker 26, function as an audio interface to the user and are connected to the primary circuitry 24.

Communication functions are performed through a radio frequency circuit 28 which includes a wireless signal receiver and a wireless signal transmitter that are connected to a MIMO antenna assembly 30. The antenna assembly 30 may be carried within the lower portion of the housing 21 and will be described in greater detail herein.

The mobile wireless communication device 20 also may comprise one or auxiliary input/output devices 27, such as, for example, a WLAN (e.g., Bluetooth®, IEEE. 802.11) antenna and circuits for WLAN communication capabilities, and/or a satellite positioning system (e.g., GPS, Galileo, etc.) receiver and antenna to provide position location capabilities, as will be appreciated by those skilled in the art. Other examples of auxiliary I/O devices 27 include a second audio output transducer (e.g., a speaker for speakerphone operation), and a camera lens for providing digital camera capabilities, an electrical device connector (e.g., USB, headphone, secure digital (SD) or memory card, etc.).

Figure 2:
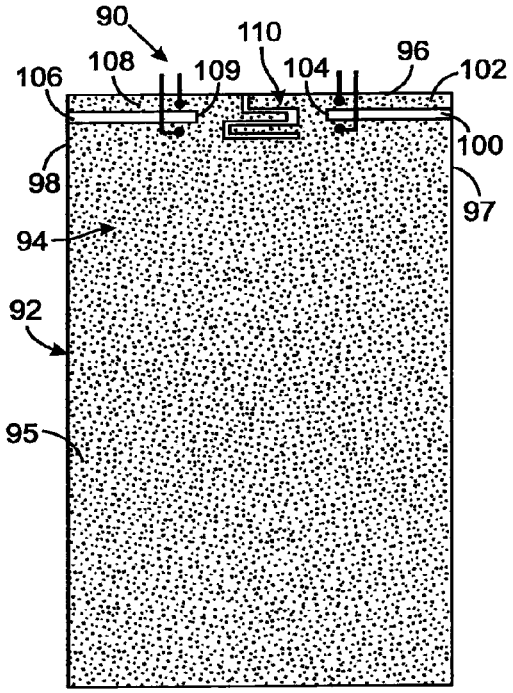
FIG. 2 is a plane view of a printed circuit board on which a version of a two port antenna assembly is formed.
Figure 3:
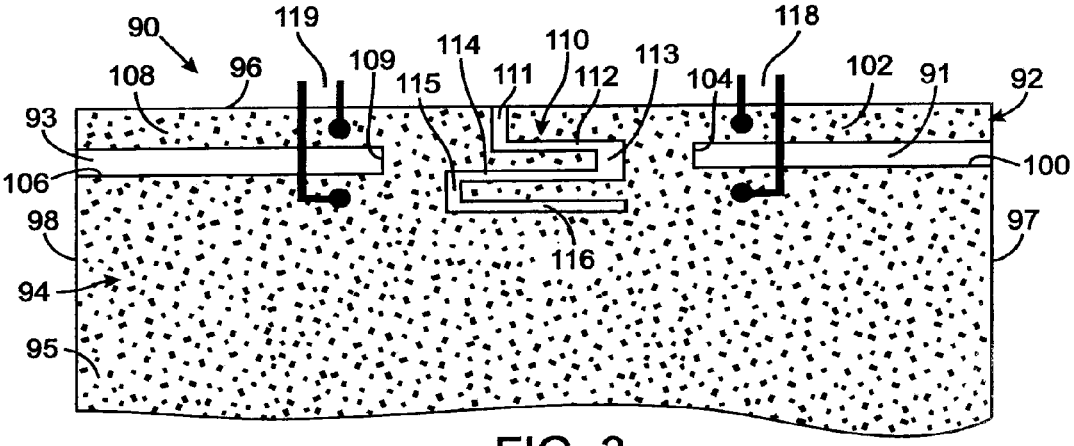
FIG. 3 is a an enlarged view of a portion of the printed circuit board in FIG. 5.

With reference to FIGS. 2 and 3, a first antenna assembly 90 is formed on a printed circuit board 92 that has a non-conductive substrate 91 with a major surface 93 on which a conductive layer 94 is applied to form a ground plane 95. The major surface 93 of the substrate on which the conductive layer is applied has a first edge 96 and two side edges 97 and 98 that are orthogonal to the first edge. A first slot antenna 100 is formed by producing an open-ended slot entirely through the thickness of the conductive layer 94 and extending inwardly from the second edge 97 parallel to and spaced at some distance from the first edge 96. The first slot antenna 100 terminates at an end 104. Similarly a second slot antenna 106 is formed by a second slot extending inwardly from the third edge 98 parallel to and spaced from the first edge 96 and terminating at a second end 109. In this embodiment, the slots of the two antenna 100 and 106 extend inward from a opposing edge of the ground plane and longitudinally parallel to a common edge of the ground plane and thus are aligned parallel to each other. The two slots form first and second radiating elements of the first and second slot antennas 100 and 106, respectively, and are spaced apart by at least one tenth of a wavelength of a resonant frequency of the second radiating element. The first and second slot antennas 100 and 106 oppose each other across a width of the ground plane 95 and may have substantially identical shapes.

The ground plane 95 extends along three sides of the first and second slots 100 and 106. A first conducting strip 102 and a second conducting strip 108 are formed between the first edge 96 and the open-ended slots 100 and 106 respectively. The width of the conducting strips 102 and 108 can be adjusted to optimize antenna resonance frequency and bandwidth.

A first signal port 118 is provided by contacts on the ground plane 95 on opposite sides of the first slot antenna 100 near the inner end 104. A second signal port 119 is provided by other contacts on the ground plane 95 on opposite sides of the second slot 106 near its inner end 109.

An isolation element 110 is located through the ground plane 95 between the first and second slot antennas 100 and 106 and specifically equidistantly between the interior ends 104 and 109 of the antennas. The isolation element 110 is in the form of an isolating slot that has a serpentine pattern which meanders winding back and forth as a serpentine between the two slot antennas 100 and 106 as the isolating slot progresses inward from the first edge 96. Specifically, the isolation slot 110 has a first leg 111 that extends orthogonally inward from the substrates first edge 96, and has an inner end from which a second leg 112 extends parallel to the first edge and toward the first slot antenna 100. The second leg 112 terminates a distance from the first slot antenna 100 and a third leg 113 projects at a right angle from that end of the second leg 112 away from the first edge 96. The third leg 113 terminates at a point from which a fourth leg 114 extends parallel to the first edge 96 and toward the second slot antenna 106, terminating at a remote end. A fifth leg 115 extends at a right angle from that remote end of the fourth leg 114 orthogonally away from the first edge 96. The fifth leg 115 terminates at a point at which a sixth leg 116 extends parallel to the first edge 96 and toward the second edge 97 of the substrate. The six legs 111 and 116 of the isolation slot 110 provide a meandering slot that winds back and forth between the two antenna slots 100 and 106. The electrical length of this isolation slot 110 is approximately a quarter of a wavelength at the operating frequency. This isolation element 110 provides electrical separation between the two slot antennas 100 and 106. The width and length of each leg and the number of legs of the serpentine isolation slot 110 can be varied to optimize the isolation (i.e., minimize mutual coupling) between the two radiating elements of antenna assembly 90, as well as the operating bandwidth. The antenna slots 100 and 106 and the isolation slot 110 extend entirely through the thickness of the conductive layer exposing portions of the first major surface 93 of the printed circuit board substrate.

Figure 4:
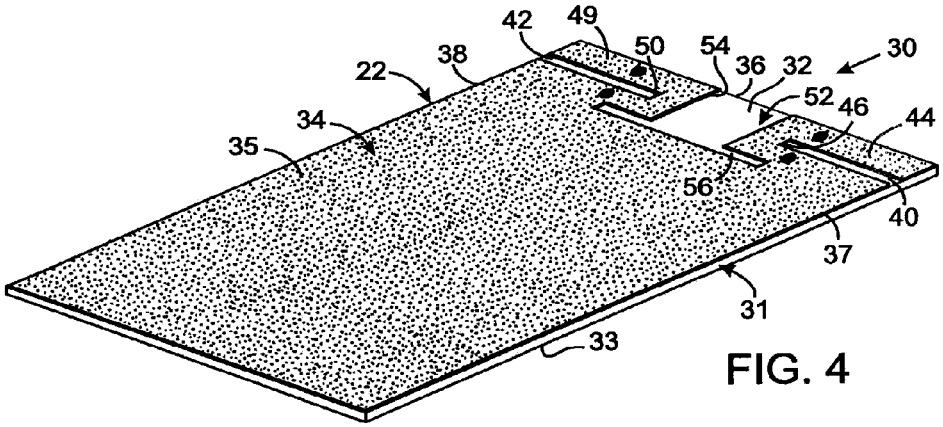
FIG. 4 is a perspective view of a printed circuit board on which a second version of the present two port antenna assembly is formed.
Figure 5:
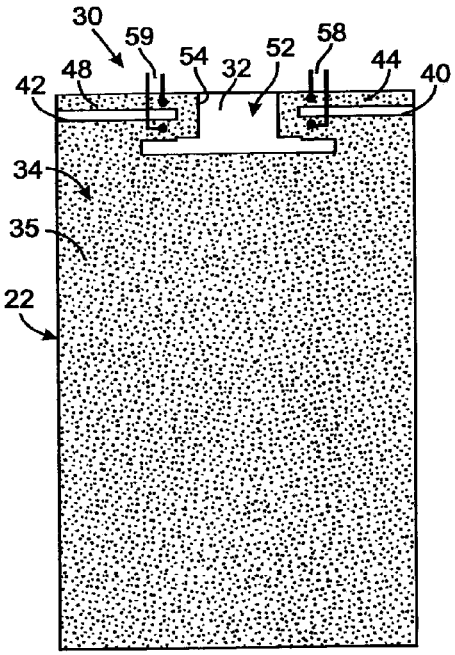
FIG. 5 is a plane view of the printed circuit board in FIG. 4.

With reference to FIGS. 4 and 5, the printed circuit board 22 has a flat substrate 31 of an electrically insulating material, such as a dielectric material commonly used for printed circuit boards. The substrate 31 has opposing first and second major surfaces 32 and 33 that are parallel to each other. The first major surface 32 has a first edge 36, and second and third edges 37 and 38 that are orthogonal to the first edge. A layer 34 of an electrically conductive material, such as copper, is adhered to the first major surface 32 to form a ground plane 35 for the antenna assembly.

The illustrated second antenna assembly 30 has a pair of quarter wavelength slot antennas 40 and 42, formed by slots that extend entirely through the thickness of layer 34 of electrically conductive material, close to edge 36, exposing the first major surface 32 of the insulating substrate 31. Specifically, the first antenna 40 comprises a slot extending in a straight line, inward from the second edge 37 and parallel to the first edge 36. The first antenna 40 has an end 46 that is remote from the second edge 37. A portion of the conductive layer 34 is between the first antenna slot 40 and the first edge 36 of the substrate 31, and forms a strip 44, which is connected to the remainder of the conductive layer 34. A linear second slot extends inward from the third edge 38 along the first edge 36 terminating at an end 50, forming the second antenna 42. Another portion of the conductive layer 34 is between the second antenna slot 42 and the first edge 36 of the substrate 31, and forms a strip 48 which is connected to the remainder of the conductive layer 34. The slots of the first and second slot antennas 40 and 42 form first and second radiating elements, respectively, and are spaced apart by at least one tenth of a wavelength of a resonant frequency of the second radiating element. The first and second slot antennas 40 and 42 oppose each other across a width of the ground plane 35.

The length of each of the slots, forming antennas 40 and 42, is close to a quarter of a wavelength of the operating frequency. However, it should be understood that each antenna may have a different size than the other, in some embodiments. The width of the two conducting strips 44 and 48 affects the impedance bandwidth and the resonance frequency of the antennas. Those widths can be chosen so that a quarter wavelength resonance mode is excited on each of the antennas 40 and 42. In some embodiments, the first and second antenna slots 40 and 42 lie on a common line. The two inner ends 46 and 50 of the first and second slots 40 and 42 are spaced apart and are inward from the respective second and third edges 37 and 38 of the first major surface 32.

The first and second antennas 40 and 42 are isolated from each other by a patterned slot cut in the conductive layer 34, between the radiating elements 40 and 42. In the antenna embodiment in FIGS. 4 and 5, that pattern forms an isolation elements that comprises a slot formed at equal distances between first and second slots 40 and 42 in the ground plane 35. This isolation slot 52 has a T-shape with a wide first section 54 extending inwardly from the first edge 36 of the ground plane 35 to a terminus beyond the first and second antennas 40 and 42. A second section 56 of the isolation slot 52 projects from the terminus orthogonally to the first section 54 and outward on opposite sides of that first section, thereby forming a T-shaped pattern. The second section 56 of the slot 52 extends parallel to the first and second slots 40 and 42. With specific reference to FIG. 5, the width of the slot's second section 56 optionally may be stepped, thereby varying the width of the portion of the conductive layer 34 between that second section and the first and second slots 40 and 42. As noted previously, those slots 40 and 42 and the slot 52 extend entirely through the thickness of the conductive layer exposing portions of the first major surface 32 of the substrate 31.

A first signal port 58 is provided by excitation contacts on the ground plane 35 on opposite sides of the first slot 40 spaced from the first end 46. Similarly, a second signal port 59 has excitation contacts on the ground plane 35 on opposite sides of the second slot 42 spaced from the second end 50. When an excitation signal is applied between the contacts of one of the ports, the electric current flowing in the ground plane around the respective slot creates an radiating field in the slot, which thereby acts as the radiating element of the antenna assembly.

The first and second signal ports 58 and 59 are connected to the radio frequency circuit 28, which uses the first and second radiating elements 40 and 42 to transmit and receive signals. That operation can have different modes in which only one of the two radiating elements 40 and 42 is used to send or receive a signal. Alternatively, two separate excitation signals can be applied simultaneously, one signal to each of the slot antennas. At other times, different signals can be received simultaneously by each of the slot antennas 40 and 42.

The isolation slot 52 provides isolation between the slot antennas 40 and 42 that minimizes electromagnetic propagation between the radiating elements, This is achieved by isolating currents induced on the conductive layer 34 of ground plane 35 from the radiating elements. The dimensions of the two sections of the slot 52 are chosen to minimize mutual coupling between the slot antennas 40 and 42.

Figure 6:
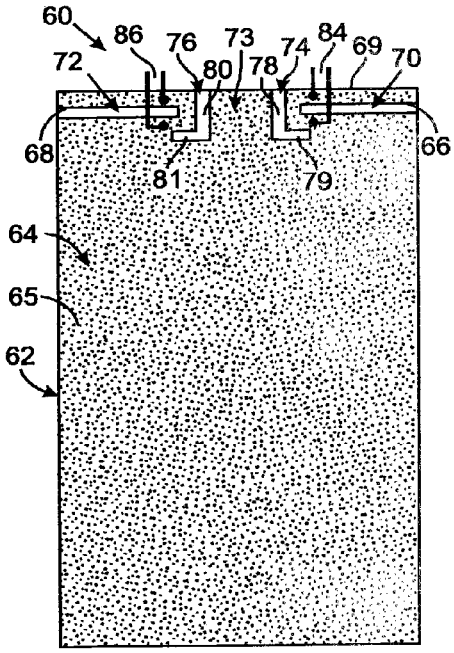
FIG. 6 is a plane view of a printed circuit board on which a third version of a two port antenna assembly is formed.

FIG. 6 illustrates a different slot pattern that provides the isolation. A third antenna assembly 60 also has a printed circuit board 62 with a major surface on which a layer 64 of conductive material is formed. As with the second antenna assembly in FIGS. 4 and 5, the third antenna assembly 60 has a pair of open end slots 66 and 68 extending inward from opposite sides parallel to a first edge 69 of the substrate. Each of the first and second slots 66 and 68 has a portion of the ground plane 65 on three sides. The third antenna assembly 60 has first and second signal ports 84 and 86 with excitation contacts for applying a first and a second signal, respectively, to the first and second antennas 66 and 68.

An isolation slot pattern 73 comprises first and second L-shaped isolation slots 74 and 76 each forming a meandering pattern. The first isolation slot 74 has a first leg 78 that extends inwardly from the first edge 69 of the substrate's first major surface on which the conductive ground plane 65 is applied. The first leg 78 extends inwardly beyond the first slot 66 terminating at an end from which a second leg 79 projects toward and parallel to the first slot. The second isolation slot 76 has a first leg 80 similarly extending inwardly through the conductive layer from the first edge 65. That first leg 80 extends beyond the second slot 68 terminating at an end from which a fourth leg projects toward and parallel to the second slot 68.

Figure 7:
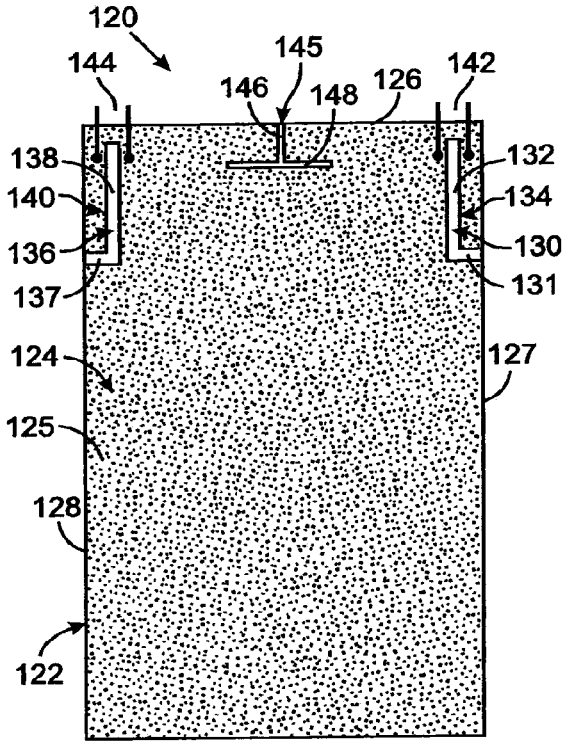

FIG. 7 depicts a fourth antenna assembly 120 formed on a printed circuit board 122 that has a major surface on which a layer 124 of conductive material, such as copper, is applied to form a ground plane 125. The major surface of the circuit board has a first edge 126 and second and third edges 127 and 128 orthogonal to the first edge. The first radiating element 134 is defined by an open-ended first slot 130 having an L-shape with a short first leg 131 extending inwardly from and orthogonally to the second edge 127 terminating at an inner end. A longer second slot leg 132 extends, from that an inner end, toward the first edge 126 and parallel to and spaced form the second edge 127. The first slot 130 is spaced from the first edge 126, thereby defining a radiating element. The second radiating element 140 is defined by an L-shaped second slot 136 with a short first leg 137 extending inwardly from and orthogonally to the third edge 128. A longer second slot leg 138 extends from the inner end of the first slot leg 137 spaced parallel from the third edge 128 and toward the first edge 126. The second slot 136 is spaced from the first edge 126 and provides a second radiating element.

The ground plane 125 extends around each of the first and second slots 130 and 136. A first signal port 142 has contacts on opposite sides of the first slot 130 near the end that is spaced from the substrate's first edge 96. A second signal port 144 is similarly located with respect to the second slot 136.

The first and second antennas 134 and 140 are isolated from each other by a T-shaped isolation slot 145 which has a first leg 146 extending inwardly through the ground plane 125, perpendicular to the first edge 126 and terminating at an inner end. A second leg 148 extends orthogonally to the first leg 146 and is centered at the remote end of that first leg. Thus, the top of the T shaped isolation slot 145 is spaced inward from the first edge 126. The isolation slot 145 serves the same functions as the previous isolation slots in minimizing electromagnetic propagation from one radiating element to another.

Figure 8:
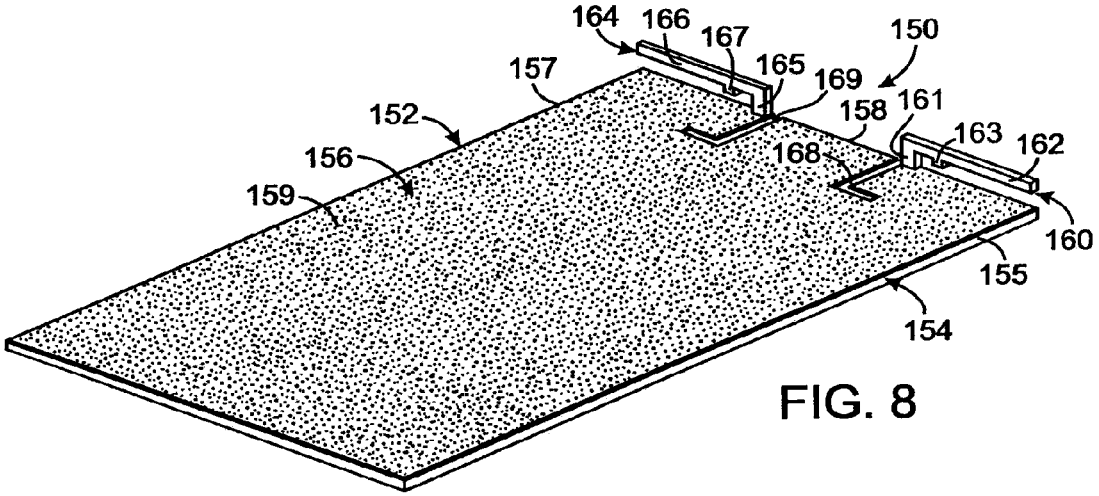
FIG. 8 is a perspective view of a printed circuit board from which elements project in an orthogonal plane.

All the previously described slot antennas are coplanar with the ground plane on the printed circuit board and are formed by slots through that ground plane, such as by a conventional photolithographic etching process or by machining. FIG. 8 discloses an alternative embodiment of an antenna assembly according to the present concepts. This fifth antenna assembly 150 is formed on a printed circuit board 152 that has a substrate 154 with a major surface that has a first edge 158 and second and third edges 155 and 157 abutting the first edge. A layer 156 of conductive material is applied to the major surface of the substrate to form a ground plane 159.

The fifth antenna assembly 150 includes a first and second inverted F antennas (IFA) 160 and 164 spaced apart at the first edge 158 of the substrate. A short conductive first support 161 is mechanically and electrically connected to the conductive layer 156 at the first edge 158 of the substrate and projects away from the substrate, and forms a ground pin for the first inverted F antenna 160. A straight first arm 162 extends from an upper portion of the first support 161 parallel to and spaced from the first edge 158. A first signal pin 163 is spaced from the ground pin 161 and is connected to the first arm 162 at one end and has a signal contact at the other end. The ground pin 161, signal pin 163, and the first arm 162 form the first inverted F antenna 160.

A short conductive second support 165 is mechanically and electrically connected to the conductive layer 156 at the first edge 158 of the substrate and projecting away from the substrate and forming a ground pin for the second inverted F antenna 164. A straight second arm 166 extends from an upper portion of the second support 165 parallel to and spaced from the first edge 158 and terminates adjacent the third edge 157 of the substrate. A second signal pin 167 is spaced from the ground pin 165 and is connected to arm 166 at one end and has a signal contact at the other end. The ground pin 165, signal pin 167, and the second arm 166 form the second inverted F antenna 164. The first and second inverted F antennas 160 and 164 oppose each other across a width of the ground plane 159.

It should be understood that the two antennas need not be of the same type. For example, one antenna may be a slot type, while the other may be an inverted F antenna.

The fifth antenna assembly 150 includes a pair of L-shaped isolation slots 168 and 169 in the conductive layer 156 forming the ground plane, which slots are similar to the isolation slots 74 and 76 described with respect to the third embodiment in FIG. 6. Specifically in FIG. 8, each isolation slot 168 and 169 has a long leg extending inward from the first edge 158 and then having a second shorter leg that projects from the interior end of the first leg toward the closest side edge 155 or 157, respectively.

The foregoing description was primarily directed to a certain embodiments of the antenna. Although some attention was given to various alternatives, it is anticipated that one skilled in the art will likely realize additional alternatives that are now apparent from the disclosure of these embodiments. Accordingly, the scope of the coverage should be determined from the following claims and not limited by the above disclosure.

The invention claimed is:

1. An antenna assembly for a wireless communication device comprising:

a ground plane formed by a layer of electrically conductive material on a substrate of non-conductive material, the layer of electrically conductive material having a thickness;

a first radiating element formed by a first radiation slot disposed in the ground plane conductive material;

a second radiating element formed by a second radiation slot disposed in the ground plane conductive material and spaced apart from the first radiating element by at least one-tenth of a wavelength of a resonant frequency of the second radiating element, the first and second radiating elements configured for operation over a bandwidth;

a first signal port provided by contacts on the ground plane conductive material on opposing sides of the first radiation slot;

a second signal port provided by other contacts on the ground plane conductive material on opposing sides of the second radiation slot, wherein mutual coupling occurs between the first radiating element and the second radiating element;

an isolating element formed in the ground plane conductive material interposed between the first radiating element and the second radiating element;

the isolating element comprising:

a meandering slot extending through the thickness of the ground plane to the underlying substrate, including an electrical length of a quarter wavelength of an operating frequency of the antenna, wherein the meandering slot has a first leg that extends orthogonally inward from an edge of the ground plane common to the first and second radiating elements, the first leg terminating at an inner end, and the meandering slot further comprises a second leg extending from the inner end parallel to the common edge and toward the first radiating element terminating at a first remote end, a third leg projecting from the first remote end and orthogonally away from the common edge until terminating at a second remote end, and a fourth leg extending from the second remote end parallel to the common edge and toward the second radiating element wherein a width and length of at least one leg is different to the others, to reduce said mutual coupling between the first radiating element and the second radiating element over the operating bandwidth of the slot antennas.

2. The antenna assembly as recited in claim 1 wherein the first and the second radiating elements have substantially identical shapes and oppose each other across a width of the ground plane.

3. The antenna assembly as recited in claim 1 wherein at least one of the first and the second radiating elements comprises an inverted F antenna of an electrically conductive material.

4. The antenna assembly of claim 1 wherein the first and the second slots are in a form of an elongated opening in the layer of electrically conductive material, each slot extending inward from an opposing edge of the ground plane and longitudinally parallel to the common edge of the ground plane.

5. The antenna assembly of claim 4 wherein the isolating element is disposed at equal distances from the first and the second radiating elements.

6. The antenna assembly of claim 1 wherein at least one of the first and the second radiating elements comprises an L-shaped slot, extending from an edge of the ground plane.

7. The antenna assembly of claim 1 wherein the meandering slot further comprises a fifth leg projecting from an end of the fourth leg and away from the common edge until terminating at a third remote end, a sixth leg extending from the third remote end parallel to the common edge and toward the first radiating element.

8. The antenna assembly of claim 1 wherein the isolating element is disposed at equal distances from the first and the second radiating elements.

9. The antenna assembly of claim 1 wherein the first radiation slot, the second radiation slot and the meandering slot all pass through the thickness of the layer of electrically conductive material.

10. The antenna assembly of claim 9 wherein the first radiation slot is linear; and the second radiation slot is linear and aligned parallel to the first radiation slot.

11. The antenna assembly of claim 9 wherein the first radiation slot and the second radiation slot both have an L-shape having a first leg and a second leg.

12. The antenna assembly of claim 1 wherein the meandering slot has a serpentine shape.

* * * * *